United States Patent [19]

Fleischer

[11] 4,012,623

[45] Mar. 15, 1977

[54] COUNTING AND INDICATING SYSTEM

[75] Inventor: Donald Whiting Fleischer, Wethersfield, Conn.

[73] Assignee: Veeder Industries, Inc., Hartford, Conn.

[22] Filed: June 5, 1975

[21] Appl. No.: 584,216

[52] U.S. Cl. ..... 235/92 FL; 235/92 A; 235/92 R; 222/28; 340/378 MW

[51] Int. Cl.[2] ..... B67D 5/06; G08B 28/00; G06M 1/10

[58] Field of Search ..... 235/92 FL, 92 A, 92 CC, 235/92 CA, 94 A, 94 R; 222/28, 23; 73/194 E; 335/181; 340/319, 378 MW, 317, 318, 316

[56] References Cited

UNITED STATES PATENTS

| | | | |
|---|---|---|---|
| 2,855,149 | 10/1958 | Bickford et al. | 235/92 FL |
| 3,253,127 | 5/1966 | Morreale | 235/92 A |
| 3,391,274 | 7/1968 | Avery | 235/92 A |
| 3,576,975 | 5/1971 | Maass | 235/92 A |
| 3,598,283 | 8/1971 | Krutz et al. | 235/92 FL |

*Primary Examiner*—Joseph M. Thesz
*Attorney, Agent, or Firm*—Prutzman, Hayes, Kalb & Chilton

[57] ABSTRACT

A fuel delivery pump having a resettable register for registering the volume and cost amounts of each fuel delivery and employing conventional resettable volume counters and new electromagnetic cost counters composed of banks of decade modules, each having an electromagnetically positioned wheel and an electronic drive circuit for indexing the wheel in stepwise fashion by electromagnetically accelerating and then decelerating the wheel.

31 Claims, 6 Drawing Figures

COUNTING AND INDICATING SYSTEM

BACKGROUND AND SUMMARY OF THE INVENTION

The present invention relates to a new and improved counting and indicating system having notable utility in registers of the type employed in fuel dispensing apparatus for registering the volume and cost amounts of fuel delivered and, for example, utility in the factory modification and/or field or factory conversion of existing fuel pump registers of the type shown and described in U.S. Pat. No. 2,814,444 of Harvey N. Bliss dated Nov. 26, 1957 and entitled "Register".

The conventional mechanical fuel pump register of the type shown and described in U.S. Pat. No. 2,814,444 has upper and lower resettable cost and volume counters on each of two opposite sides of the register for registering the cost and volume amounts of the fuel delivered. The register is conventionally employed with a mechanical variator (for example, of the type disclosed in U.S. Pat. No. 3,413,867 of Richard B. Hamlin dated Dec. 3, 1968 and entitled "Variator") operable for establishing and posting the desired unit volume price of fuel. The variator is connected for being driven by a fuel meter and for driving the volume and cost counters of the register for registering the volume amount of fuel delivered (e.g., in gallons) and the cost amount of fuel delivered in accordance with the volume amount of fuel delivered and the established unit volume price.

The mechanical cost counter drive train is rotated at a rate proportional to the established unit volume price and the volumetric rate of delivery and, therefore, for any given maximum volumetric rate of delivery, its maximum rate of rotation increases proportionally with the unit volume price of gasoline. Since the price of gasoline is escalating and is likely to continue to escalate, the cost counter drive train is and will continue to be rotated at correspondingly increasing rates. The resulting higher rotational speed decreases the life and increases the operating noise of the mechanical cost counter and its drive train. The higher rotational speed also increases the required drive torque transmitted from the meter through the variator to the cost counters and therefore decreases the useful life of the variator and the accuracy of the meter.

It is therefore a principal aim of the present invention to provide a new and improved counting and indicating system for a conventional fuel pump register for converting and/or modifying the register for increasing the useful life of the fuel pump register and its associated meter and variator.

It is another aim of the present invention to provide new and improved register conversion means of the type described which permits conversion of existing mechanical register with minimum inconvenience and downtime.

It is another aim of the present invention to provide a modified fuel pump register employing a new and improved cost counter providing a visual readout which may be the same as or similar to the visual readout of existing fuel pump registers and whereby its appearance to the customer may be made to the same or similar.

It is a further aim of the present invention to provide a new and improved gasoline pump register having an improved resettable cost counter.

It is another aim of the present invention to provide a new and improved register conversion kit useful for modifying the cost and/or volume section registers of the type described in the aforementioned U.S. Pat. No. 2,814,444.

It is a further aim of the present invention to provide a new and improved fuel pump register having an expanded cost and/or volume readout and yet which is substantially the same size as existing fuel pump registers and such that improved register can be readily substituted for and existing register and without further modification of the fuel pump.

It is another aim of the present invention to provide in a counting and indicating system of the type employing one or more indicating wheels, a new and improved wheel operating system for positioning each wheel.

It is a still further aim of the present invention to provide a counting and indicating system of the type having an electronic storage register for storing a count and one or more mechanical digital indicators for displaying the stored count, a new and improved indicator positioning means for positioning each digital indicator in accordance with the corresponding digit count of electronic storage register.

It is another aim of the present invention to provide a new and improved single wheel indicator module usable alone or in a bank thereof as a numeral display or the like.

Other objects will be in part obvious and in part pointed out more in detail hereinafter.

A better understanding of the invention will be obtained from the following detailed description and the accompanying drawings of an illustrative application of the invention.

DESCRIPTION OF THE PREFERRED EMBODIMENTS

Figure 1:
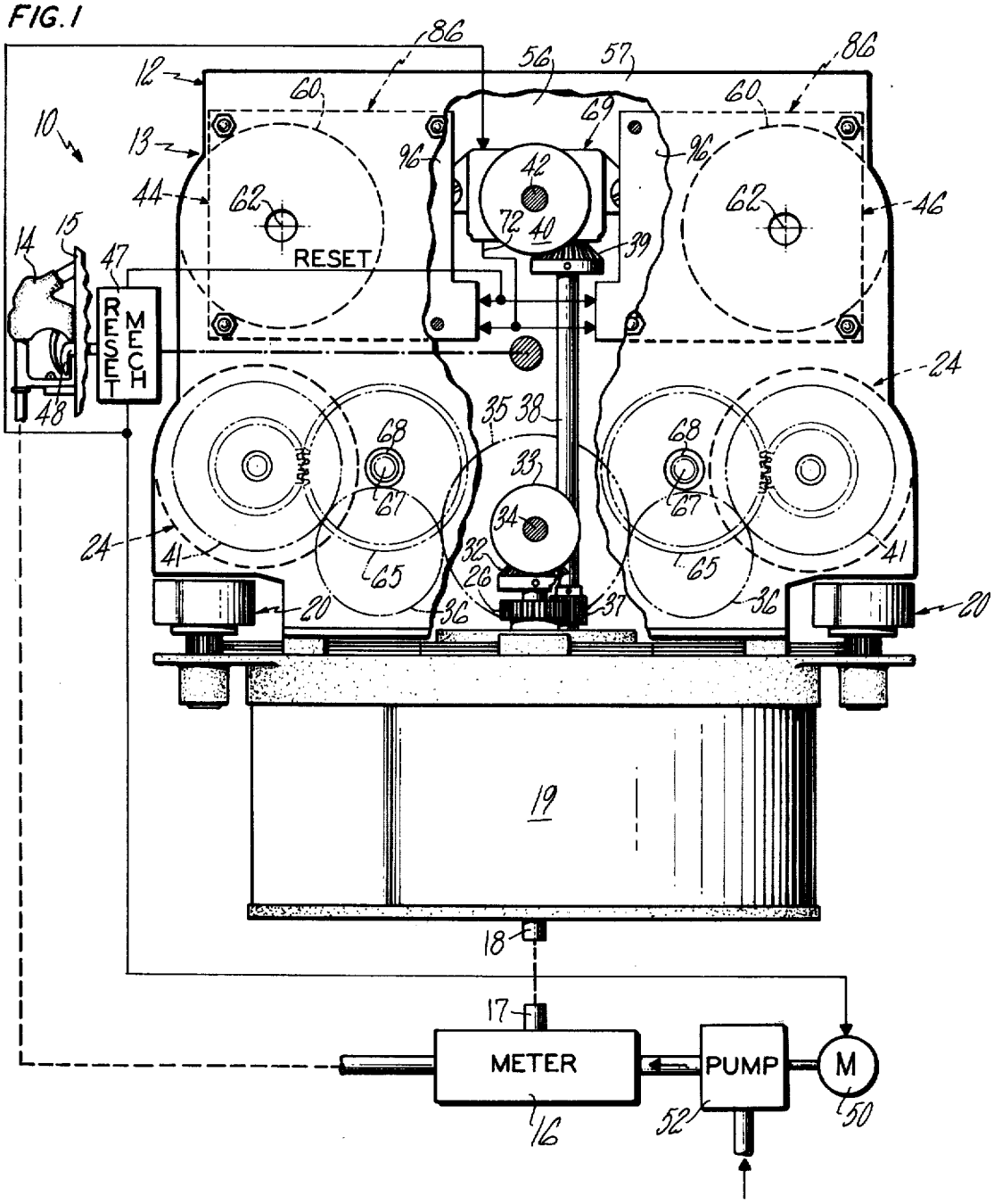
FIG. 1 is a generally diagrammatic side elevation view, partly broken away and partly in section, of a gasoline dispensing pump having a fuel pump register incorporating an embodiment of the counting and indicating system of the present invention.

Referring now to the drawings in detail wherein like reference numerals indicate like parts throughout the several figures, a gasoline delivery pump 10 employing a register 12 incorporating an embodiment 13 of the counting and indicating system of the present invention is shown having a nozzle 14 for delivering fuel and a suitable nozzle storage receptacle 15 for storing the nozzle 14 between fuel deliveries. In a conventional manner, a meter 16 provided in the fuel delivery conduit has a rotary output shaft 17 driven in accordance with the volume amount of fuel delivered. The meter shaft 17 is suitably coupled to an imput or center shaft 18 of a variator 19 of the type described in the aforementioned U.S. Pat. No. 3,413,867. Briefly, the variator comprises three settable range arms (not shown) of ascending order of significance which can be individually manually set into engagement with selected gear steps of a cone gear (not shown) to collectively establish the desired unit volume price of fuel within a three place price range. The variator also comprises two sets of price posting wheels 20 mechanically connected to the range arms for posting the three place unit volume price established by the range arm settings at the opposite ends of the pump.

The variator center shaft 18 extends through the variator and is mechanically connected (via bevel gears 32, 33, a horizontal volume shaft 34, shaft and idler gears 35, 36 and lowest order wheel drive gears 41) for driving a pair of volume counters 24 of the register 12 located directly above the variator price wheels 20. A rotary output gear 26 of the variator rotatably mounted on the variator center shaft 18 is driven by the meter 16 via the variator cone gear and variator range arms in accordance with the established unit volume price. The variator output gear 26 is mechanically connected via a gear 37, vertical shaft 38 and bevel gears 39, 40 for driving a horizontal cost shaft 42 of the register. The horizontal cost shaft 42 in conventional registers of the type disclosed in the aforementioned U.S. Pat. No. 2,814,444 is mechanically connected for driving a pair of mechanical cost counters (not shown) located directly above the volume counters 24 for registering the cost amount of fuel dispensed in accordance with the volume amount dispensed and the unit price established by the variator setting. In accordance with the present invention, the conventional mechanical cost counters are removed in the case of a conversion, or are not employed in the case of an original construction of a modified register incorporating the present invention. In either case, a pair of substitute cost counters 44, 46, hereinafter described, are provided in place of the conventional mechanical cost counters.

The resettable register 12 has a suitable conventional mechanical or motor driven reset mechanism 47 (shown diagrammatically in FIG. 1) operable by a register control handle 48. The register control handle 48 is positioned adjacent the nozzle storage receptacle 15 and such that the handle 48 has to be rotated to its vertical or "off" position to permit the nozzle 14 to be placed in its storage receptacle at the completion of a fuel delivery, and the nozzle 14 has to be removed from its storage receptacle 15 to permit the handle 48 to be rotated to its horizontal or "on" position. Rotation of the handle 48 to its vertical or "off" position provides for de-energizing a pump drive motor 50 for a gasoline delivery pump 52 and for conditioning the register 12 for being reset, and rotation of the handle 48 to its horizontal or "on" provides for sequentially resetting the volume counter wheels to zero and then reconditioning the volume counters 24 for registering the volume of the succeeding fuel delivery. The register reset mechanism 47 also provides for re-energizing the motor 50 after the volume counters 24 have been reset and the register is conditioned for recording the subsequent delivery.

The pair of substitute cost counters 44, 46 are mounted and suitably retained between the side plates 56, 57 of the conventional register frame in place of the conventional mechanical cost counters (not shown). The coaxial indicator or number wheels 60 of each cost counter 44, 46 are essentially the same diameter and mounted for rotation about the same axis 62 as the prior conventional cost counter wheels. The cost counters 44, 46 are compactly made preferably so they may be directly laterally inserted into the end cavities between the side plates 56, 57 above the volume counters 24. Also, the cost counters 44, 46 preferably provide an additional number wheel 60 (i.e., five coaxial number wheels instead of the usual four wheels of conventional mechanical cost counters); and for that reason, the conventional large wheel reset gears (of conventional mechanical registers of the type disclosed in U.S. Pat. No. 2,814,444) provided for resetting both the cost and volume counter wheels are replaced by smaller reset gears 65 mounted on shafts 67 relocated to suitable lower positions provided by bushings 68 inserted into additional bores in the register side plates 56, 57. The end cavities within the register side plates 56, 57 are thereby made sufficiently open for receiving the substitute five wheel cost counters 44, 46.

A rotary electrical pulse generator 69, for example, a rotary pulse generator of the type described in U.S. Pat. No. 3,786,272 of John G. Gamble et al dated Jan. 15, 1974 and entitled "Hall Effect Rotary Pulse Generator", is mounted within the register 12 against the inside face of one of the side plates 56, 57 for being directly driven by the horizontal cost shaft 42. The pulse generator 69 is thereby driven for generating a train of electrical cost pulses in its output 72 with a cost pulse generated for each predetermined angular increment of rotation of the horizontal cost shaft 42 and therefore for each predetermined incremental cost amount of fluid delivered. In the shown embodiment, the cost shaft bevel drive gears 39, 40 establish a gear ratio so that the pulse generator 68 provides five equally spaced cost pulses for each cost unit of the lowest order cost wheel, in the described example, five pulses for each one-cent cost unit of fuel delivered.

Figure 3:
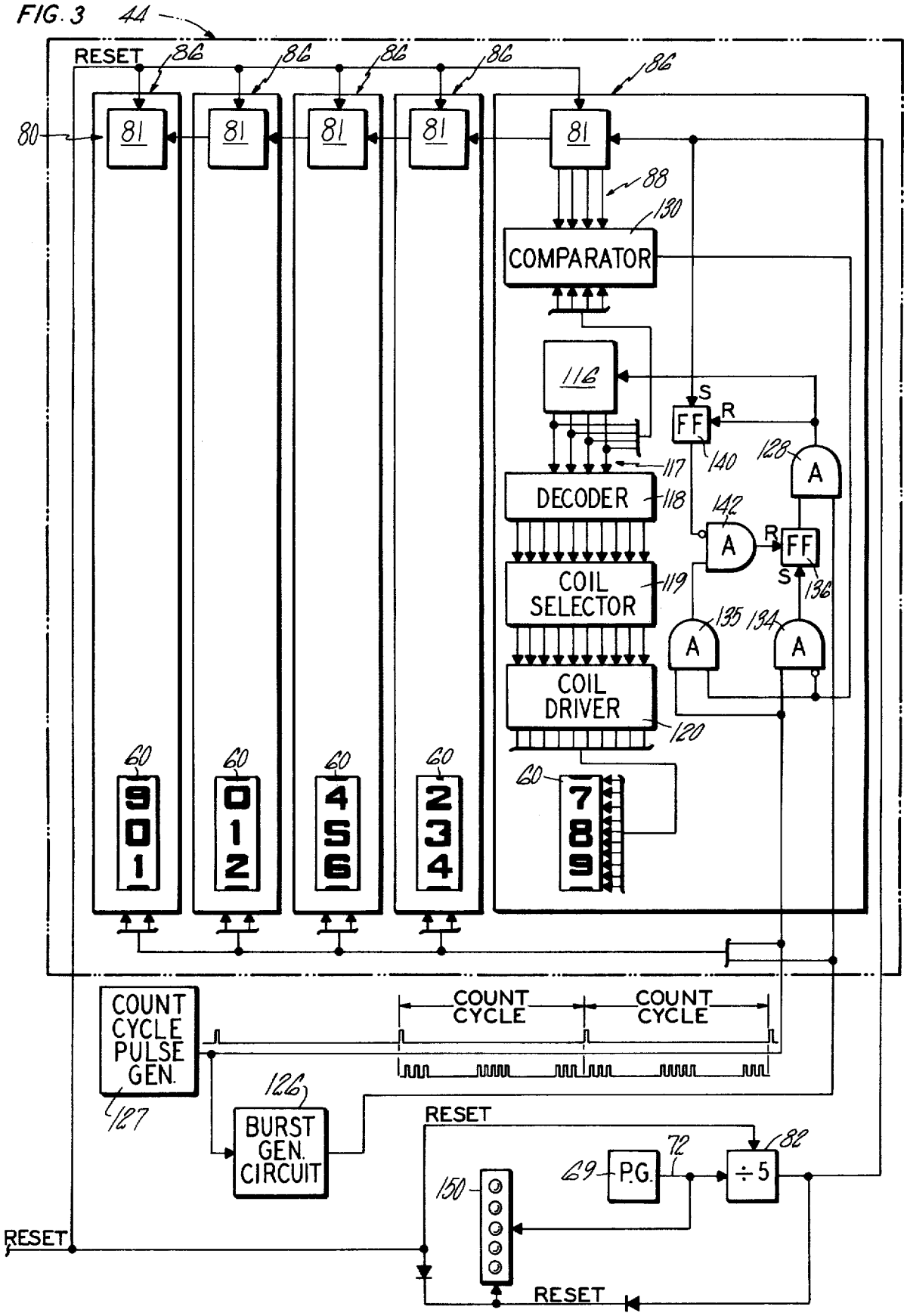
FIG. 3 is a combination diagrammatic and schematic illustration, partly broken away, of the counting and indicating system.

Referring to FIG. 3, the cost register 44 comprises an electronic counter 80 having five separate BCD storage decades or counters 81 of ascending order of significance for the five indicator wheel 60 respectively. The pulse generator output lead 72 is connected via a divide-by-five (÷5) input counter section 82 to the lowest order BCD storage decade 81, and in a conventional manner each lower order BCD storage decade 81 is connected to transmit a carry or transfer pulse to the adjacent higher order decade 81 for each ten input pulses to the lower order decade. The electronic counter 80 and input counter section 82 are suitably connected to the register reset mechanism 47 to be reset between fluid deliveries when the volume counters 24 are reset and, for example, when the pump control handle 48 is turned to its "on" position or in conjunction with energizing the pump motor 50 (but preferably sufficiently before the motor energization to ensure the counter wheels 60 are fully reset). During the following delivery of fuel, the counter 80 is stepped by the pulse generator 69 to accurately accumulate the cost amount of fuel delivered in the five BCD decades 81, it being seen that the input counter section 82 produces a count or transfer pulse for indexing the lowest order BCD decade 81 for each five pulses from the pulse generators 69 and therefore for each $0.01 cost amount of fuel delivered. The pulse generator 69 is not reset in the described embodiment when the register 12 is reset (although, if desired, suitable additional mechanical means could be provided in the reset mechanism 47 for resetting the pulse generator 69 with the volume counters 24), and therefore the counter section 82 is preferably reset to its two or three count condition and such that each unit cost pulse transmitted to the lowest order decade 81 is timed to occur after approximately half of the unit cost increment of fuel is delivered.

The cost register 44 comprises five separate decade modules 86 of increasing order of significance which are preferably substantially identical, and for simplicity of illustration, the electronic circuitry of only the lowest order decade module 86 is schematically shown in FIG. 3. Each such module 86 comprises a corresponding BCD decade 81 of the counter 80, and the BCD output 88 of the decade 81 is applied to a wheel positioning circuit, hereinafter described, for positioning the respective number wheel 60 in accordance with the count stored in the BCD decade 81. Consequently, the row of five coaxial 0–9 number wheels 60 provide for displaying the cost stored on the counter 80 from $100.00 to $999.99.

Figure 4:
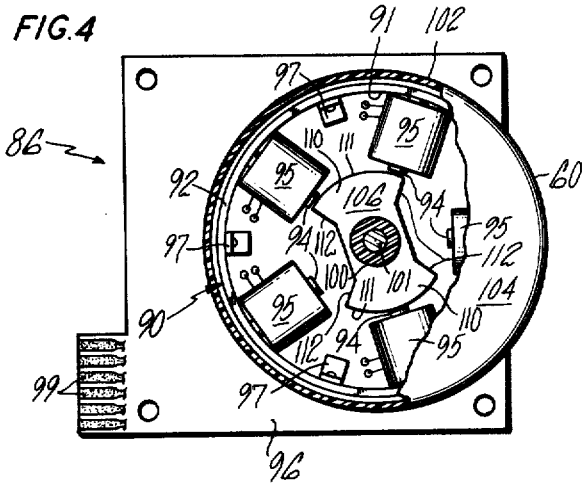
FIG. 4 is an enlarged side view, partly broken away and partly in section, of an indicator module of the counting and indicating system.

Referring to FIG. 4, each number wheel is adapted to be electromagnetically positioned at each of its ten digital or readout positions for selectively and sequentially displaying its 0–9 sequence of numerals. For that purpose, the decade module 86 comprises a stator 90 having a generally flat stator core 91 with an outer circular ring 92 and five equiangularly spaced (i.e., 72° spaced) radially inwardly extending salient poles 94 and corresponding salient pole windings 95. The stator core 91 (which, for example, may be made of flat soft iron laminations or injection molded of a suitable, magnetic plastic) is mounted on a printed circuit (PC) board 96 with suitable angularly spaced supports or standoffs 97 secured to the PC board. The stator winding leads 98 are soldered to the PB board to provide electrical connections to the PC board circuit, and the decade module circuit including the BCD decade 81 and remaining electronic components to be described are mounted on and connected via the PC board to provide an economical and compact decade module assembly. The PC board also has suitable printed circuit connectors 99 for supplying electrical power to the module 86, for the three electrical inputs to the module and for transmitting the carry or transfer output of the BCD storage decade 81 of the module. The number wheel 60 has a central hub 100 rotatably mounted on a stub shaft 101 secured to the PC board 96, an outer 0-9 numeral bearing rim 102 encircling the stator ring 92 and an intermediate rim support web 104. A permanent magnet 106 is secured onto the wheel hu 100 for rotation within the plane of the stator poles 94 and so that the rotor magnet 106 (and therefore the entire number wheel 60) is adapted to be positioned by the stator field.

The permanent magnet 106 has a diametral magnetic axis and diametrically opposed north and south truncated magnetic pole sectors 110 with circumferentially extending pole faces 111 and radially extending edge portions 112. The pole faces 111 have a circumferential or angular width substantially equal to the included angle of a pair of adjacent stator poles 94 (i.e., 78° where the angular width of each stator pole face is 60°). In each of the ten equiangularly spaced numeral readout positions of the wheel 60, one of the rotor poles 110, hereinafter referred to as the "primary" rotor pole, is radially aligned with one of the five stator poles 94, hereinafter referred to as the "primary" stator pole, and the remaining "secondary" rotor pole 110 is radially aligned between the opposite pair of "secondary" stator poles 94 and with the circumferential end portions of its pole face 111 in radial alignment with the pole faces of the "secondary" stator poles 94. The number heel 60 is adapted to be positioned in any selected digit position by magnetizing the appropriate stator pole 94 as the "primary" pole and with the appropriate polarity to attract the appropriate "primary" rotor pole 110 and by magnetizing the opposite pair of "secondary" stator poles with the opposite polarity to center the "secondary" rotor pole therebetween. The set of three active stator coils 95 are preferably maintained energized to hold the wheel in each count position; however, if a power failure occurs, the wheel 60 will remain locked in its last position by the magnetic detenting or attraction between the rotor magnet and salient stator poles.

The number wheel 60 is magnetically indexed in the counting or adding direction, in the counterclockwise direction as viewed in FIG. 4, in part by initially urging the counter three steps or counts (i.e., 108°) in the counting direction from the existing digit position. For that purpose, the existing active set of three stator windings would be de-energized first and then the prior inactive stator pole winding 95 "trailing" (clockwise of) the prior "primary" winding would be energized as the primary winding to repel or urge the adjacent rotor pole 110 and attract the opposite rotor pole and therefore, in both cases, to urge the rotor in the counting direction. Simultaneously, the opposite or "secondary" pair of salient stator pole windings would be energized to repel the adjacent rotor pole and 110 and attract the other rotor pole, in both cases to urge the rotor in the desired counting direction. Thus, by magnetizing the stator 90 in a manner to step the indicator wheel 60 three steps or counts in the adding direction, the stator and rotor magnetically cooperate very effectively and with considerable magnetic force to urge the number wheel 60 away from its existing digital position and toward its adjacent position, and such that the wheel 60 is accelerated relatively quickly from its prior rest position. Similarly, the wheel 60 can be angularly urged with considerable magnetic force and accelerated in the reverse or subtracting angular direction by apropriately energizing the "leading" set of stator coils 95.

Each indicator module 86 has a second BCD storage decade 116 like the BCD decade 81 and having a BCD output 117 for positioning the number wheel 60. For that purpose, the BCD output 117 is connected to the five stator coils 95 via a BCD to decimal decoder 118, a coil selector or encoder 119 for selecting the appropriate three stator coil windings and the direction of energization of each coil, and a suitable coil driver circuit 120. The coil driver circuit 120 is connected to the five stator coils 95, two leads to each stator coil, and so that the appropriate three stator coils are energized, each in the appropriate direction, to position the numeral wheel at the digital position corresponding to the count stored in the BCD storage decade 116.

The storage decade 116 functions as a secondary or slave BCD storage decade to the primary or master BCD storage decade 81, and the slave storage decade 116 is indexed in a pre-established manner by relatively high frequency pulse bursts (e.g., at 200 kHz) from a burst generator circuit 126 for automatically updating the BCD count of the slave decade 116 to the BCD count of the master BCD storage decade 81. The secondary BCD storage decade 116 is updated by the burst generator 126 at a substantially fixed predetermined count rate established by spaced "count" or "sync" timing pulses from a count cycle pulse generator 127. The fixed predetermined count rate is established to be approximately equal to but preferably slightly less than the maximum start/stop counting rate of the number wheel 60 and whereby the wheel is indexed at substantially is maximum rate and yet is at rest at its full count position, to avoid any wheel oscillation or other erratic wheel movement, when the succeeding count cycle begins.

A suitable comparison circuit 130 is provided for comparing the BCD output of the slave BCD storage decade 116 with the BCD output of the master BCD storage decade 81. When the master and slave BCD storage decades 81, 116 are in agreement, the resulting comparison output signal from the comparator 130 operates a pair of count cycle start and stop control gates 134, 135 to enable the succeeding "sync" pulse to reset a flip-flop 136 to close the pulse control gate 128 to the slave decade 116. The pulse control gate 128 remains closed as long as the slave and master decades 116, 81 are in agreement. When the slave and master decades are not in agreement, the "sync" pulse is transmitted via the start control gate 134 to set the flip-flop 136 and thereby connect the burst generator 126 for indexing the slave decade 116.

The output pulse train from the burst generator 126 will continue to step the slave decade 116 until it catches up to the primary decade 81, or the primary decade 81 "laps" or catches up to the slave decade 116 (in either case, when the BCD count of the slave decade 116 equals that of the primary decade 81), whereupon the count control gate 128 will be closed by the succeeding "sync" pulse to disconnect the burst generator 126 from the slave decade 116.

The burst generator 126 is cycled by each "sync" pulse to generate eleven count pulses (i.e., equal to the number of wheel positions plus one) during each count cycle and between "sync" pulses. The eleven pulse count cycle consists of an initial pulse burst of three pulses, a intermediate pulse burst of five pulses and a final pulse burst of three pulses, each pulse burst being generated at a relatively high pulse burst frequency (e.g., 200 kHz). A predetermined and a very short wheel acceleration interval (e.g., 23 milliseconds) is provided between the initial and intermediate pulse bursts for accelerating the indicator wheel from its prior full count position, and a second predetermined and very short wheel deceleration interval (e.g., 17 milliseconds) is provided between the intermediate and final pulse bursts for decelerating the indicator wheel 60 to its next full count position. In addition, a third predetermined and very short rest interval is provided between the last pulse burst of each count cycle and the first pulse burst of the succeeding count cycle for ensuring that the indicator wheel is at rest at its full count position before the next count cycle begins. The rest interval is a function of the "sync" pulse frequency and the "sync" pulse frequency is established accordingly.

The first pulse burst of each cycle is the first pulse burst to the secondary storage decade 116 after the control flip-flop 136 is set. The three pulses of the first pulse burst provide for stepping the slave BCD storage decade 116 three counts and whereby the number wheel 60 is angularly urged and accelerated from its existing full count rest position in the adding direction. The predetermined acceleration time interval between the first and intermediate pulse bursts (e.g., 23 milliseconds) is established so that the second or intermediate pulse burst occurs approximately as the indicator wheel reaches an intermediate or one-half count position.

The next or intermediate pulse burst of five pulses provides for stepping the secondary decade 116 five additional counts. The secondary decade 116 is then indexed a total of eight counts (i.e., three counts from the first burst and five counts from the second burst) and whereby the resulting magnetic field of the stator provides a substantial subtracting or reverse angular bias for decelerating the rotating indicator wheel.

The third or final pulse burst of three pulses provides for stepping the secondary decade 116 three additional counts to provide a total of eleven counts (from the first, second and third pulse bursts) and therefore for stepping the secondary decade 116 to a end count which is just one count from its initial count. The predetermined deceleration time interval (e.g., 17 milliseconds) between the second and third pulse bursts is established so that the third pulse burst is generated just as the indicator wheel 60 is decelerated to a stop at its next full count position. The end count of the secondary decade 116 then provides for holding the number wheel 60 at that full count position to complete the count cycle.

It can be seen therefore that during each count cycle, the first pulse burst provides for maximum available acceleration of the number wheel 60 from its prior count position to approximately a one-half count position and the second pulse burst provides for maximum available deceleration of the number wheel 60 to a stop at the succeeding full count position. The third pulse burst provides for holding the indicator wheel at the succeeding full count position and the third rest interval is provided for ensuring that the number wheel is at a full count rest position before the succeeding count cycle begins. The acceleration time interval is slightly longer than the deceleration time interval because of the presence of drag (including air drag and bearing friction) which decreases the rate of acceleration and increases the rate of deceleration. Also, the acceleration and deceleration time intervals are preferably established so that the number wheel is decelerated to a stop at the full count position and so that indicator blinking at the full count position is avoided.

A flip-flop 140 and control gate 142 are provided in the slave decade input control circuit to prevent the control flip-flop 136 from being reset when a count pulse is transmitted to the master decade 81 momentarily after the completion of an eleven-pulse burst cycle which effects a compare signal. In that event, the control flip-flop 136 is not reset by the immediately following "sync" pulse, as would otherwise be the case, and the succeeding count cycle is effective in indexing the counter wheel 60. Such reset inhibit circuitry is useful in maintaining the wheel indexing circuit active and in avoiding losing a count cycle when the master decade 81 is being indexed to "lap" the slave decade 116.

It can be seen that the slave decade 116 and counter wheel 60 are never more than nine counts behind the master decade 81. Also, as the lowest order decade 81 is counting at the highest rate and the higher order decades 81 are counting at progressively lower rates, the two or three highest order decade wheels 60, depending on the volumetric rate of delivery of fuel and the unit volume price, will likely track their respective BCD decades 81. In any event, preferably all of the decade modules 86 are functionally and electrically similar, are interchangeable and provide for stepping the number wheel at the maximum available rate by accelerating and then decelerating the number wheel as described.

The opposite cost register 46 may be substantially identical to the cost register 44 and composed of five decade modules 86 connected as described with respect to the cost register 44. Alternatively, the four lead BCD outputs 117 of each slave storage decade 116 of the cost register 44 could be connected directly to the decoder 118 of the corresponding decade module of the cost register 46. In that event, the entire cost counter 46 would function as a slave counter to the cost counter 44. Also, the interconnection between the cost counters 44, 46 could be made at different levels, for example, to provide common inputs to their coil selectors 119, coil drivers 120 or to their stator coils 95.

The wheel inertia and drag are preferably very low and so that the indicator wheel 60 can be rapidly accelerated and decelerated and can be indexed at a counting rate (e.g., a counting rate of approximately twenty digits per second) above the visually readable range. Consequently, if the indicator wheel is being indexed slow enough to be visually readable, it will be accurately tracking and displaying the count of the primary BCD storage decade 81. Also, if a fuel delivery is made at a high rate and is then slowed, for example, in order to terminate the delivery at a desired total cost, the cost counter readout will not be discernable and therefore misleading before the cost counter readout corresponds to the count of the primary counter 80.

Figure 2:
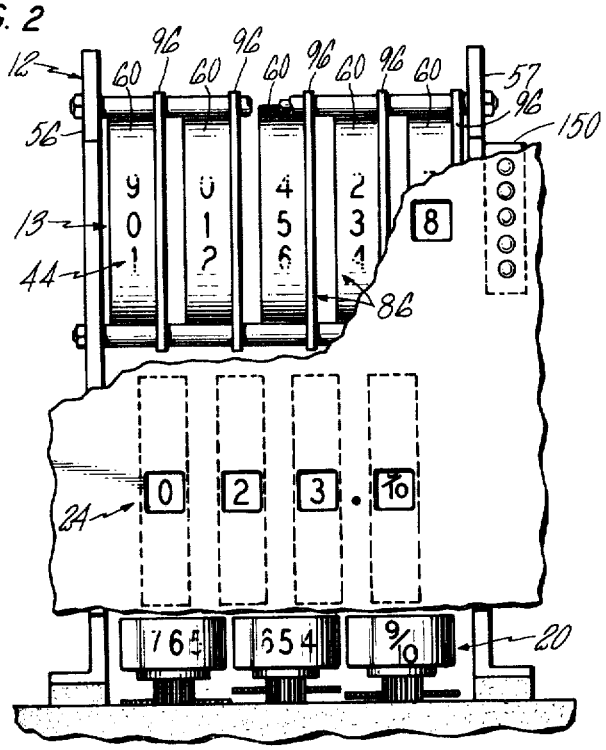
FIG. 2 is a partial front elevation view, partly broken away and partly in section, of the dispensing pump.

Referring to FIGS. 2 and 3, a suitable resettable one-fifth cent indicator 150 could be connected to be indexed by the pulse generator 69 to provide an analogue type presentation for assisting in terminating a fuel delivery at the desired total cost. Also, a suitable resettable units or lowest order 0–9 number wheel (not shown) driven by the horizontal cost shaft 42 to provide an analogue display, could be provided in addition to or in lieu of the units decade module 86 to assist in terminating a delivery at the desired total cost.

Figure 5:
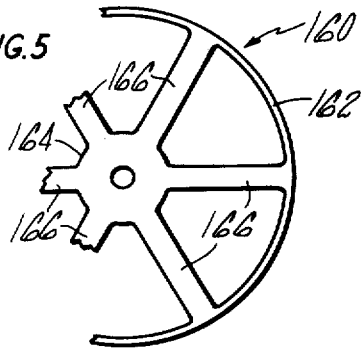
FIGS. 5 and 6 are enlarged side and isometric views, partly broken away, of modified number wheels of the indicator module.
Figure 6:
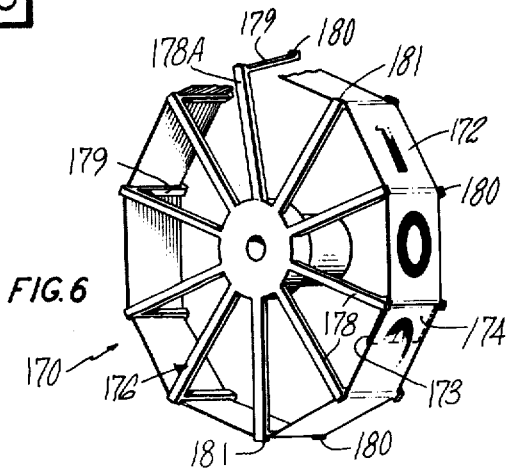

A modified molded plastic number wheel 160, having a very low moment of inertia is shown in FIG. 5. The number wheel 160 has a very thin and light cylindrical numeral bearing shell 162, a hub 164 and a plurality of equiangularly spaced shell support spokes 166 extending radially between the hub 164 and shell 162. Another modified number wheel 170, shown in FIG. 6, has a polygonal (i.e., ten-sided) numeral bearing shell 172 formed of a flexible and very thin and light ribbon or tape of Mylar plastic or the like and whereby the angular moment of inertia of the shell 172 is exceedingly low. In addition, a supply reel of ribbon for a large number of wheels can be preprinted with the appropriate 0-9 sequence of numeral indicia, for example, by feeding the ribbon from the supply reel through a suitable printing device and onto a take-up reel. An appropriate section of the preprinted ribbon is then severed from the preprinted ribbon supply, formed into a ring, for example with its ends 173, 174 overlapping and suitably secured together, and then mounted and secured onto a molded plastic ribbon support frame 176 of the wheel 170. In that regard, the wheel frame 176 is preferably formed with ten equiangularly spaced resilient spokes 178 having outer generally axially extending cantilever support arms 179 for supporting and holding the ribbon shell. The support arms 179 have outer hooked ends 180, 181 for retaining the ribbon shell 172 in place, and the resilient spokes 178 preferably are slightly bent from a normal or unstressed condition (shown by the spoke 178A) to hold the ribbon shell taut. The ribbon shell 172 is preferably dimensioned to be completely free from frictional engagement with the stator assembly. Alternatively, instead of employing the spoke support shown in FIG. 6, the ribbon shell 172 could be loosely supported to rotate on a fixed plastic cylindrical shell (not shown) of the stator assembly and connected to be rotated with its wheel magnet with only a single drive spoke (not shown).

The described fuel pump register modification is therefore useful in the conversion of standard fuel pump registers for increasing the useful life of the fuel pump register and its associated meter and variator. Such a modified fuel pump register could incorporate substitute volume counters like the substitute cost counters 44, 46 and a corresponding volume pulse generator like the cost pulse generator 69 and similarly driven by the horizontal volume shaft 34. Also, where the register is modified to incorporate both substitute cost and volume counters, it is contemplated that the variator 19 and cost pulse generator 69 could be replaced by a single volume pulse generator, like the cost pulse generator 69 and connected to be driven directly by the meter 16, and by a suitable presettable electronic cost computer (for example, of the type described in U.S. Pat. No. 3,696,236 of Crawford M. Kus dated Oct. 3, 1972 and entitled "Computing Device") operable by the volume pulses from the volume pulse generator to generate cost pulses for stepping the cost counter 80 to accurately accumulate the cost amount of fuel delivered in accordance with a unit volume price established by the setting of the electronic cost computer. In that event, the single volume pulse generator would provide the volume pulse input to the electronic cost computer and to an electronic volume counter of the volume counter section.

As will be apparent to persons skilled in the art, various modifications, adaptations and variations of the foregoing specific disclosure can be made without departing from the teachings of the present invention.

I claim:

1. In a resettable register for a fuel pump computer having a variator with a rotary volume shaft adapted to be driven by a fuel meter in accordance with the volume amount of fuel delivered, the variator being settable for establishing the unit volume price of the fuel and having a rotary cost output driven by the variator volume shaft in accordance with the unit volume price established by the variator setting; the resettable register comprising a register frame with a pair of spaced generally parallel side members, resettable volume and cost counter sections having oppositely facing pairs of volume and cost readout counters with parallel banks of coaxial counter wheels of increasing order mounted between the register side members, the volume readout counters being resettable mechanical readout counters, volume counter mechanical drive means adapted to be operatively connected to the rotary volume shaft of the variator to mechanically drive the mechanical volume counters to provide volume readouts of the volume amount of fuel delivered, cost counter drive means adapted to be operatively connected to the rotary cost output of the variator to drive the cost counters to provide cost readouts of the cost amount of fuel delivered, and register reset means for mechanically resetting the mechanical volume counters and for resetting the cost counter section between fuel deliveries; the improvement wherein each cost counter comprises a bank of counter wheel modules having a bank of said coaxial cost counter wheels of increasing order respectively, each of the counter wheel modules having electromagnetic wheel positioning means for the respective cost counter wheel adapted to be selectively energized for selectively angularly positioning the wheel, the electromagnetic wheel positioning means of each bank of counter wheel modules being selectively energizable for selectively angularly positioning the bank of cost counter wheels for providing a selected cost readout; wherein the cost counter drive means comprises pulse generator means and pulse generator operating means adapted to be operatively connected to the rotary cost output of the variator to operate the pulse generator means to generate an electrical pulse train with a pulse for each predetermined incremental cost amount of fuel delivered; wherein the resettable cost counter section comprises resettable primary electronic counter means connected to the pulse generator to be operated by the electrical pulse train to accumulate a cost count of the cost amount of fuel delivered, and electrical drive means operated by the primary electronic counter means for selectively energizing the electromagnetic wheel positioning means for each cost counter wheel to position the coaxial cost counter wheels of each bank for providing a cost readout of the cost count accumulated in the primary electronic counter means; and wherein the register reset means is operable between fuel deliveries for resetting the cost counters by resetting the electronic counter means of the cost counter section.

2. A resettable register according to claim 1 wherein the cost counter wheels are decade wheels with peripheral generally cylindrical rims respectively of flexible ribbon bearing a ten digit sequence equiangularly therearound.

3. A resettable register according to claim 2 wherein each of said cost counter wheels comprises a rim support with ten generally equiangularly spaced support spokes tautly supporting the flexible ribbon rim at ten substantially equiangularly spaced positions to form a ten-sided polygonal rim of said flexible ribbon, and wherein the flexible ribbon rim bears the ten digit sequence on the ten sides thereof respectively.

4. A resettable register according to claim 1 wherein the electrical drive means comprises a plurality of wheel drive means for the plurality of cost counter wheels of increasing order respectively, the plurality of wheel drive means being selectively operable through multiple-phase count cycles thereof respectively for multiple-phase energization of the electromagnetic wheel positioning means respectively for angularly indexing the counter wheels in multiple-phase full count increments and fixed angular directions respectively, and control means for selectively operating the plurality of wheel drive means through said multiple-phase count cycles thereof respectively for selectively indexing the cost counter wheels for providing a cost readout of the cost count of the electronic counter means.

5. A resettable register according to claim 4 wherein the said plurality of wheel drive means are selectively operable through said multiple-phase count cycles thereof respectively to provide multiple-phase sequential energization of the electromagnetic wheel positioning means respectively in first and second different electromagnetic phases thereof respectively for electromagnetically angularly accelerating the counter wheels respectively from prior count positions and in said fixed angular directions respectively to intermediate positions intermediate said prior count positions and the succeeding count positions respectively and for electromagnetically angularly decelerating the counter wheels respectively from their intermediate positions to their said succeeding count positions respectively.

6. A resettable register according to claim 1 wherein the pulse generator operating means comprises a rotary cost drive shaft rotatably mounted on the register frame between the spaced side members, and wherein the pulse generator means comprises a rotary pulse generator mounted on the frame between the spaced side members and connected to be driven by the cost drive shaft.

7. An indicating system comprising a muiltiple position rotary mechanical indicator adapted to be angularly positioned in each of a plurality of successive angular indicating positions thereof, electromagnetic positioning means adapted to be selectively energized for selectively positioning the mechanical indicator in each of its plurality of indicating positions respectively, master and slave electronic selectors respectively selectively operable for selecting each position of the multiple position rotary mechanical indicator, the slave selector being adapted to be repetitively indexed in a predetermined direction through a selector cycle of a plurality of successive steps corresponding to the plurality of successive positions of the rotary mechanical indicator respectively, electrical drive means for selectively energizing the electromagnetic positioning means to selectively position the mechanical indicator at its angular position corresponding to the step of the slave electronic selector, and slave selector indexing means for selectively indexing the slave selector in said predetermined direction to angularly index the rotary mechanical indicator at a fixed indexing interval in a corresponding angular direction and to successive positions thereof respectively and with the indicator coming to rest at each successive position and until the indicator position corresponds to the position selected with the master selector, the slave selector indexing means being operable for indexing the slave selector from a prior step to a succeeding step corresponding to the prior and succeeding rest indicating positions respectively of the rotary indicator, by stepping the slave selector in said predetermined direction through a multiple-phase stepping cycle including at least an entire said selector cycle and having leading and trailing intermediate phase steps, which are respectively ahead of and behind said succeeding step relative to said predetermined direction, for predetermined short intervals respectively less than said indexing interval, and a final phase step corresponding to said succeeding rest indicating position.

8. An indicating system according to claim 7 wherein the slave selector indexing means is selectively operable to rapidly index the slave selector through a full selector cycle plus one step to index the mechanical indicator to its succeeding position.

9. An electromagnetically operated rotary indicator comprising a rotary indicator wheel having an outer generally cylindrical and coaxial indicia bearing rim of flexible ribbon and a permanent magnet with a generally diameteral magnetic axis with generally diametrically opposed magnetic poles, and electromagnetic stator means cooperable with the rotor permanent magnet and adapted to be selectively energized to position the rotary indicator wheel at each of a plurality of angularly spaced indicating positions.

10. A rotary indicator according to claim 9 wherein the electromagnetic stator means comprises five radially extending salient stator poles generally equiangularly spaced about the axis of the rotary indicator for magnetic cooperation with the generally diametrically opposed poles of the rotor permanent magnet for positioning the indicator with the electromagnetic stator means in each of ten generally equiangularly spaced indicating positions.

11. A decade counting device comprising a counter wheel with ten angularly spaced count positions, electromagnetic wheel positioning means adapted to be selectively energized for selectively positioning the wheel in each of its ten count positions, master and slave electronic decade counters each adapted to be selectively indexed through successive count cycles of ten counts corresponding to the ten count positions of the counter wheel respectively, wheel operating means for selectively energizing the electromagnetic wheel positioning means to position the wheel in correspondence with the count of the slave decade counter, and slave counter indexing means operable by the master decade counter to repetitively index the slave counter in a predetermined direction thereof at a relatively high rate through eleven count indexing cycles, each operable to index the counter wheel only one count position in one predetermined angular direction thereof at a relatively slow rate, until the counts of the master and slave decade counters correspond.

12. A decade counting device according to claim 11 wherein the slave counter indexing means comprises a burst generator operator for generating a cycle of eleven pulses, in a plurality of pulse bursts, having a fixed cycle interval, a count cycle pulse generator for generating count pulses at fixed predetermined intervals greater than said fixed eleven pulse cycle interval of the burst generator, comparator means for comparing the counts of the master and slave decade counters, and control means operable by the comparator means and the count pulses of the count cycle pulse generator to selectively connect the burst generator to the slave counter to index the counter with the pulse bursts to index the counter wheel in said one direction until the counts of the slave and master decades correspond.

13. An indicating device comprising a rotary indicator wheel having a plurality of angularly spaced indicating positions, electromagnetic wheel positioning means adapted to be selectively energized for selectively angularly positioning the indicator wheel at each of its angularly spaced indicating positions, primary selector means settable for selecting each of the indicating positions of the wheel and electrical drive means for energizing the electromagnetic wheel positioning means to position the wheel in accordance with the setting of the selector means, the electrical drive means being operable to selectively energize the electromagnetic wheel positioning means to angularly index the indicator wheel to successive indicating positions thereof at a predetermined fixed rate and with the indicator at least momentarily held at rest at each position until the wheel position corresponds to the setting of the primary selector means, and to index the rotary indicator wheel from each prior indicating position to a successive indicating position thereof by automatically sequentially energizing the electromagnetic positioning means to first and second different and successive electromagnetic phases thereof respectively providing for electromagnetically angularly accelerating the indicating wheel from its prior position in said one angular direction to an intermediate position approximately midway said prior position and its next succeeding position and then angularly decelerating the wheel from its said intermediate position to its said next succeeding position.

14. An indicating device according to claim 13 wherein the electrical drive means energizes the electromagnetic wheel positioning means to index the rotary indicator by sequentially energizing the electromagnetic wheel positioning means to said first and second successive electromagnetic phases thereof and to a third succeeding electromagnetic phase for electromagnetically positioning the indicator wheel at said succeeding position.

15. An indicating device according to claim 13 wherein the first electromagnetic phase electromagnetically biases the indicator wheel from its said prior position in said one angular direction to an angular position beyond said succeeding position.

16. An indicating device according to claim 13 wherein the electrical drive means energizes the electromagnetic wheel positioning means in its said second electromagnetic phase for a predetermined time interval operative to electromagnetically bias the indicator wheel in the opposite angular direction to magnetically decelerate the indicator wheel to its said succeeding position.

17. An indicating device according to claim 16 wherein the electrical drive means energizes the electromagnetic wheel positioning means to a third electromagnetic phase after said second phase for electromagnetically positioning the indicator wheel at said succeeding position.

18. Conversion means for converting a resettable fuel pump register having a frame with a pair of spaced generally parallel side members, resettable mechanical volume and cost counters, with parallel banks of coaxial counter wheels of increasing order mountd between the register side members, providing volume and cost readouts of the volume and cost amounts of fuel delivered, rotary volume counter drive means having rotary input means adapted to be connected for driving each mechanical volume counter in accordance with the volume amount of fuel delivered, rotary cost counter drive means having rotary input means adapted to be connected for driving each mechanical cost counter in accordance with the cost amount of fuel delivered, and register reset means for mechanically resetting the resettable mechanical volume and cost counters between fuel deliveries; the improvement wherein the conversion means comprises a substitute cost counter for each mechanical cost counter having a bank of wheel modules with a bank of coaxial cost counter wheels respectively mounted between the register side members with the cost counter axis parallel to the axis of the respective mechanical cost counter, the cost counter wheel modules having individually operable electromagnetic wheel positioning means for the coaxial cost counter wheels respectively collectively operable for selectively angularly positioning the bank of coaxial wheels to provide said cost readout; the conversion means further comprising pulse generator means mounted on the register frame and connected to be driven by the rotary input means of the cost counter drive means for generating an electrical pulse train with a pulse for each fixed predetermined incremental cost amount of fuel delivered, resettable electronic counter means connected to the pulse generator to be operated by the electrical pulse train to accumulate a cost count of the cost amount of fuel delivered, electrical drive means for selectively operating the electromagnetic wheel positioning means for each wheel for electromagnetically positioning each bank of coaxial cost counter wheels to provide a cost readout of the cost count of the electronic counter means, and means connecting the resettable electronic counter means to be reset by the register reset means with the mechanical volume counters between fluid deliveries.

19. Conversion means according to claim 18 wherein each substitute cost counter comprises a bank of wheel modules with a bank of a plurality of coaxial cost counter wheels of increasing order respectively greater in number than the plurality of coaxial cost counter wheels of increasing order of the respective mechanical cost counter.

20. In a resettable register for a fuel pump computer having resettable volume and cost counters with respectve banks of coaxial counter wheels of increasing order providing volume and cost readouts of the volume and cost amounts of fuel delivered, volume counter drive means adapted to be connected for driving each volume counter in accordance with the volume amount of fuel delivered, cost counter drive means adapted to be connected for driving each cost counter in accordance with the cost amount of fuel delivered, and register reset means for resetting the resettable volume and cost counters between fuel deliveries; the improvement wherein at least each lowest order cost counter wheel has a coaxial generally cylindrical indicia bearing rim of flexible ribbon.

21. In a resettable register according to claim 20 wherein each said cost counter wheel having a flexible ribbon rim has a rim support with a plurality of generally equiangularly spaced support spokes tautly supporting the flexible ribbon rim at a plurality of substantially equiangularly spaced positions to form a polygonal rim of said flexible ribbon.

22. A method of counting by selectively electromagnetically angularly indexing a rotary counting wheel in one angular direction to each of a plurality of successive angularly spaced count positions thereof with electromagnetic wheel positioning means adapted to be selectively energized to magnetically position the counting wheel in each of its angularly spaced count positons, comprising the steps of successively selectively energizing the electromagnetic wheel positioning means to first and second different electromagnetic conditions thereof respectively electromagnetically angularly biasing the rotary counting wheel in said one angular direction to angularly accelerate the wheel from each prior count position thereof to an intermediate position thereof approximately midway said prior count position and its next succeeding count position and electromagnetically biasing the rotary counting wheel in the opposite angular direction to decelerate the rotary counting wheel to its said next succeeding count position.

23. A method of counting according to claim 22 further comprising the step of successively selectively energizing the electromagnetic wheel positioning means to a third electromagnetic condition thereof electromagnetically positioning the counting wheel at said next succeeding count position.

24. A method of counting according to claim 22 wherein the angular acceleration step is provided by electromagnetically angularly biasing the rotary counting wheel in said one angular direction toward an angular position thereof beyond said next succeeding count position.

25. A method of counting according to claim 22 wherein the angular deceleration step is provided by electromagnetically angularly biasing the rotary counting wheel in said opposite angular position toward an angular position thereof preceding said prior count position.

26. In a resettable register for a fuel pump computer having a variator with a rotary volume shaft adapted to be driven by a fuel meter in accordance with the volume amount of fuel delivered, the variator being settable for establishing the unit volume price of the fuel and having a rotary cost output driven by the variator volume shaft in accordance with the unit volume price established by the variator setting; the resettable register comprising a register frame with a pair of spaced generally parallel side members, resettable volume and cost counter sections having oppositely facing pairs of volume and cost readout counters with parallel banks of coaxial counter wheels of increasing order mounted between the register side members, volume counter drive means adapted to be operatively connected to the rotary volume shaft of the variator to drive the volume counters to provide volume readouts of the volume amount of fuel delivered, cost counter drive means adapted to be operatively connected to the rotary cost output of the variator to drive the cost counters to provide cost readouts of the cost amount of fuel delivered, and register reset means for resetting the volume and cost counter sections between fuel deliveries; the improvement wherein each cost counter comprises a bank of counter wheel modules having a bank of said coaxial cost counter wheels of increasing order respectively, each of the counter wheel modules having electromagnetic wheel positioning means for the respective cost counter wheel adapted to be selectively energized for selectively angularly positioning the wheel, the electromagnetic wheel positioning means of each bank of counter wheel modules being selectively energizable for selectively angularly positioning the bank of cost counter wheels for providing a selected cost readout; wherein the cost counter drive means comprises pulse generator means and pulse generator operating means adapted to be operatively connected to the rotary cost output of the variator to operate the pulse generator means to generate an electrical pulse train with a pulse for each predetermined incremental cost amount of fuel delivered; wherein the resettable cost counter section comprises resettable primary electronic counter means connected to the pulse generator to be operated by the electrical pulse train to accumulate a cost count of the cost amount of fuel delivered, and electrical drive means operated by the primary electronic counter means for selectively energizing the electromagnetic wheel positioning means for each cost counter wheel to position the coaxial cost counter wheels of each bank for providing a cost readout of the cost count accumulated in the primary electronic counter means; and wherein the register reset means is operable between fuel deliveries for resetting the cost counters by resetting the electronic counter means of the cost counter section, the electrical drive means comprising a plurality of wheel drive means for the plurality of cost counter wheels of increasing order respectively, the plurality of wheel drive means being selectively operable through multiple-phase count cycles thereof respectively for multiple-phase energization of the electromagnetic wheel positoning means respectively for angularly indexing the counter wheels in multiple-phase full count increments in fixed angular directions respectively, and control means for selectively operating the plurality of wheel drive means through said multiple-phase count cycles thereof respectively for selectively indexing the cost counter wheels for providing a cost readout of the cost count of the electronic counter means, the cost counter wheels being decade wheels, each said wheel drive means comprising secondary electronic decade counter means adapted to be repetitively indexed through a succession of ten counts, the control means comprising stepping means for selectively indexing each secondary decade counter means in a predetermined counting direction and with a predetermined counting interval from a prior count to a succeeding count by stepping the secondary decade counter means in said predetermined counting direction through a said multiple-phase count cycle of eleven counts with predetermined leading and trailing intermediate phase counts, which are respectively ahead of and behind said succeeding count relative to said predetermined counting direction, for predetermined short intervals respectively less than said counting interval, and a final phase count at said succeeding count, the control means being selectively operable for selectively connecting the stepping means for stepping the secondary decade counter means through said multiple-phase count cycles thereof respectively until the plurality of decade counts thereof of ascending order correspond to the cost count of the electronic counter means, and each wheel drive means comprising electromagnetic operating means for energizing the respective wheel positioning means for angularly positioning the decade wheels respectively in accordance with the leading, trailing and final phase counts of the corresponding decade counter means for respectively accelerating, decelerating and positioning the counter wheels respectively.

27. An indicating device comprising a rotary indicator wheel having a plurality of angularly spaced successive indicating positions, electromagnetic wheel positioning means adapted to be selectively energized for selectively angularly positioning the indicating wheel at each of its indicating positions, position selector means adapted to be selectively set for selecting each of the indicating positions of the indicator wheel, and electrical drive means for selectively energizing the electromagnetic wheel positioning means to position the indicator wheel in accordance with the setting of the position selector means, the electrical drive means being operable to position the indicator wheel in accordance with the setting of the selector means by selectively and sequentially energizing the electromagnetic wheel positioning means to angularly index the indicator wheel from a prior rest indicating position to a succeeding rest indicating position by angularly accelerating the indicator wheel from its said prior rest position toward its said succeeding rest position to an intermediate position intermediate said prior and succeeding rest positions and angularly decelerating the indicator wheel from its said intermediate position to its said succeeding rest position, the electrical drive means comprising a counter adapted to be repetitively indexed through a counter cycle of a plurality of successive counts corresponding to the plurality of successive indicating positions respectively, stepping means for selectively indexing the counter in a predetermined counting direction and with a predetermined counting interval from a prior count to a succeeding count corresponding to said prior and succeeding rest indicating positions respectively, by stepping the counter in said predetermined counting direction through a multiple-phase count cycle including at least a full counter cycle and having leading and trailing intermediate phase counts, which are respectively ahead of and behind said succeeding count relative to said predetermined counting direction, for predetermined short intervals respectively less than said counting interval, and a final phase count at said succeeding count, control means selectively operable for selectively connecting the stepping means for stepping the counter through a said multiple-phase count cycle thereof to index the counter to the count corresponding to the setting of the position selector means, and wheel drive means for selectively energizing the electromagnetic wheel positioning means in accordance with the leading, trailing and final phase counts of the counter for accelerating, decelerating and positioning the indicator wheel respectively.

28. An indicating device according to claim 27 wherein the device further comprises a flat printed circuit board, wherein the rotary indicator wheel is rotatably mounted on the board with its axis of rotation generally normal thereto; wherein the electromagnetic wheel positioning means comprises a permanent magnet on the wheel, and electromagnetic stator means mounted on the printed circuit board for magnetic cooperation with the permanent magnet and has stator winding means electrically connected to the printed circuit board and adapted to be selectively energized for selectively magnetically positioning the permanent magnet and thereby selectively magnetically angularly position the indicator wheel in each of its indicating positions; wherein the selector means and electrical drive means are mounted on the printed circuit board and are operatively electrically connected to each other with the printed circuit board, and wherein the electrical drive means is operatively electrically connected to the stator winding means with the printed circuit board.

29. An electromagnetically operated rotary indicator comprising a rotary indicator wheel having an outer generally cylindrical and coaxial indicia bearing rim of flexible ribbon and a permanent magnet with a generally diametral magnetic axis with generally diametrically opposed magnetic poles, electromagnetic stator means cooperable with the rotor permanent magnet and adapted to be selectively energized to position the rotary indicator wheel at each of a plurality of angularly spaced indicating positions, the electromagnetic stator means comprising five radially extending salient stator poles generally equiangularly spaced about the axis of the rotary indicator for magnetic cooperation with the generally diametrically opposed poles of the rotor permanent magnet for positioning the indicator with the electromagnetic stator means in each of ten generally equiangularly spaced indicating positions, master and slave electronic decade counters, each adapted to be indexed through repeating cycles of ten counts thereof corresponding to the ten positions of the rotary indicator wheel respectively, electrical wheel drive means for energizing the electromagnetic stator means for positioning the rotary indicator wheel in accordance with the count of the slave decade counter, a pulse burst generator for generating a multiple-phase cycle of eleven pulses in a plurality of short pulse bursts providing a wheel indexing cycle with a plurality of successive wheel positioning phases respectively, and control means for selectively connecting the burst generator for indexing the slave decade counter one count and therefore the wheel one count by indexing the slave decade counter through eleven count multiple-phase cycles thereof with the eleven pulse cycles of the burst generator respectively until the counts of the slave and master decade counters are equal.

30. An indicating device comprising a rotary indicator wheel having a plurality of angularly spaced indicating positions, electromagnetic wheel positioning means adapted to be selectively energized for selectively angularly positioning the indicator wheel at each of its angularly spaced indicating positions, primary selector means settable for selecting each of the indicating positions of the wheel, electrical drive means for energizing the electromagnetic wheel positioning means to position the wheel in accordance with the setting of the selector means, the electrical drive means being operable to selectively energize the electromagnetic wheel positioning means to angularly index the indicator wheel to successive indicating positions thereof at a predetermined fixed rate and with the indicator at least momentarily held at rest at each position until the wheel position corresponds to the setting of the primary selector means, the electrical drive means comprising an electrical counter adapted to be repetitively indexed in a predetermined counting direction through a count sequence of a plurality of counts corresponding to the plurality of indicating positions of the indicator wheel respectively, electromagnet operating means for selectively energizing the electromagnetic wheel positioning means to position the indicator wheel at the position corresponding to the count of the counter, electrical pulse generator means for repetitively generating a pulse train cycle for indexing the electrical counter at a relatively high rate in said predetermined counting direction through a count cycle having a number of counts equal to the plurality of counts in said count sequence plus one additional count for indexing the indicator wheel at a relatively low rate to a successive position thereof, comparator means for comparing the count in the counter with the setting of the primary selector means, and electrical control means operable by the comparator means for selectively connecting the electrical pulse generator means for indexing the counter through said count cycles thereof until the count of the counter corresponds with the setting of the selector means.

31. An indicating device comprising a rotary indicator wheel having a plurality of angularly spaced indicating positions, electromagnetic wheel positioning means adapted to be selectively energized for selectively angularly positioning the indicator wheel at each of its angularly spaced indicating positions, primary selector means settable for selecting each of the indicating positions of the wheel, and electrical drive means for energizing the electromagnetic wheel positioning means to position the wheel in accordance with the setting of the selector means, the electrical drive means being operable to selectively energize the electromagnetic wheel positioning means to angularly index the indicator wheel to successive indicating positions thereof at a predetermined fixed rate and with the indicator at least momentarily held at rest at each position until the wheel position corresponds to the setting of the primary selector means, the primary selector means comprising a master electronic counter and the electrical drive means comprising a slave electronic counter, each of the master and slave counters being adapted to be indexed through repeating cycles of a plurality of counts thereof corresponding to the plurality of indicating positions of the rotary indicator wheel respectively, the electrical drive means comprising electrical wheel drive means for energizing the electromagnetic wheel positioning means for positioning the rotary indicator wheel in accordance with the count of the slave counter, a pulse burst generator for generating a multiple-phase pulse cycle having a plurality of pulses equal to the sum of said plurality of counts in the counting cycle plus one, in a plurality of short pulse bursts providing a wheel indexing cycle with a plurality of successive wheel positioning phases respectively, and control means for selectively connecting the burst generator for indexing the slave counter one count and therefore the wheel one count by indexing the slave counter through multiple-phase cycles thereof with the pulse cycles of the burst generator respectively until the counts of the slave and master counters are equal.

* * * * *